United States Patent [19]

Herbst

[11] Patent Number: 5,002,191

[45] Date of Patent: Mar. 26, 1991

[54] KNOCKDOWN HANGING FILE

[75] Inventor: Manfred O. Herbst, Levittown, N.Y.

[73] Assignee: Esselte Pendaflex Corporation, Garden City, N.Y.

[21] Appl. No.: 266,136

[22] Filed: Nov. 2, 1988

[51] Int. Cl.[5] ..... A47F 7/16

[52] U.S. Cl. ..... 211/46; 211/133; 211/195; 312/257.1

[58] Field of Search ..... 211/46, 85, 195, 133, 211/189, 186, 135, 162, 11, 191; 312/184, 195, 257 R, 257.1

[56] References Cited

U.S. PATENT DOCUMENTS

| | | | |
|---|---|---|---|
| 1,772,438 | 8/1930 | Cubberley | 211/11 |
| 1,805,068 | 5/1931 | Arlt | 211/133 X |
| 2,623,527 | 12/1952 | Guichard | 211/11 X |
| 2,800,907 | 7/1957 | Jonas | 211/162 |
| 3,630,387 | 12/1971 | Wehner | 211/195 X |
| 4,145,098 | 3/1979 | Alexander | 312/195 |
| 4,173,379 | 11/1979 | van der Heiden et al. | 312/257 X |
| 4,296,982 | 10/1981 | Kullander | 211/135 X |
| 4,545,490 | 10/1985 | Hsiao et al. | 211/191 |
| 4,848,859 | 7/1989 | Edmonds et al. | 312/257.1 |

OTHER PUBLICATIONS

United Stationers 1988 catalog, pp. (c) 114. and 115.
Oxford Furniture Catalog F, p. F3.
United Stationers 1989 catalog, p. 76.

*Primary Examiner*—David L. Talbot
*Assistant Examiner*—Daniel Hulseberg
*Attorney, Agent, or Firm*—Darby & Darby

[57] ABSTRACT

A knockdown file cart which can be easily assembled without tools or fasteners, and which is rigid when assembled. The cart has two upstanding side panels with metal strips at their edges which form troughs. Two end panels have inwardly projecting flanges which can be slid down in the troughs and releasable locked in place by a spring tab on each flange that projects into a slot in the strips. A bottom panel can be inserted to form the bottom of the cart and further improve its rigidity.

10 Claims, 3 Drawing Sheets

FIG. 3
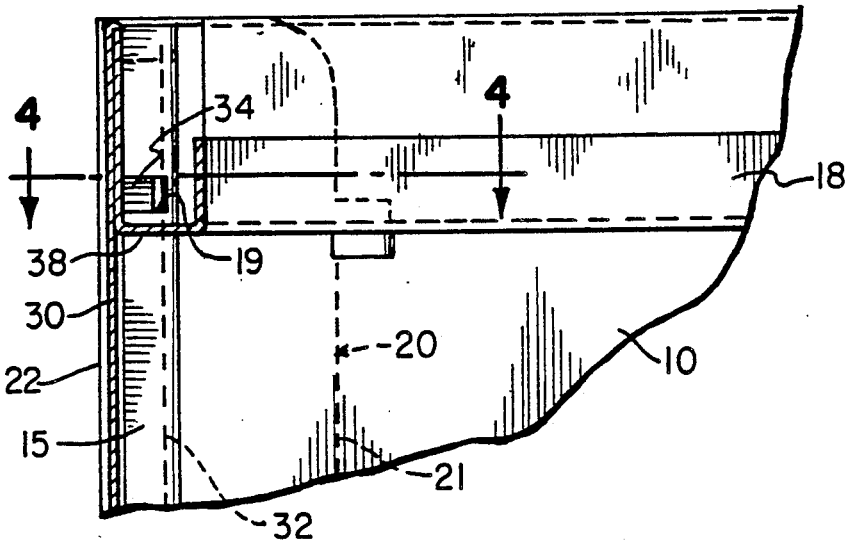
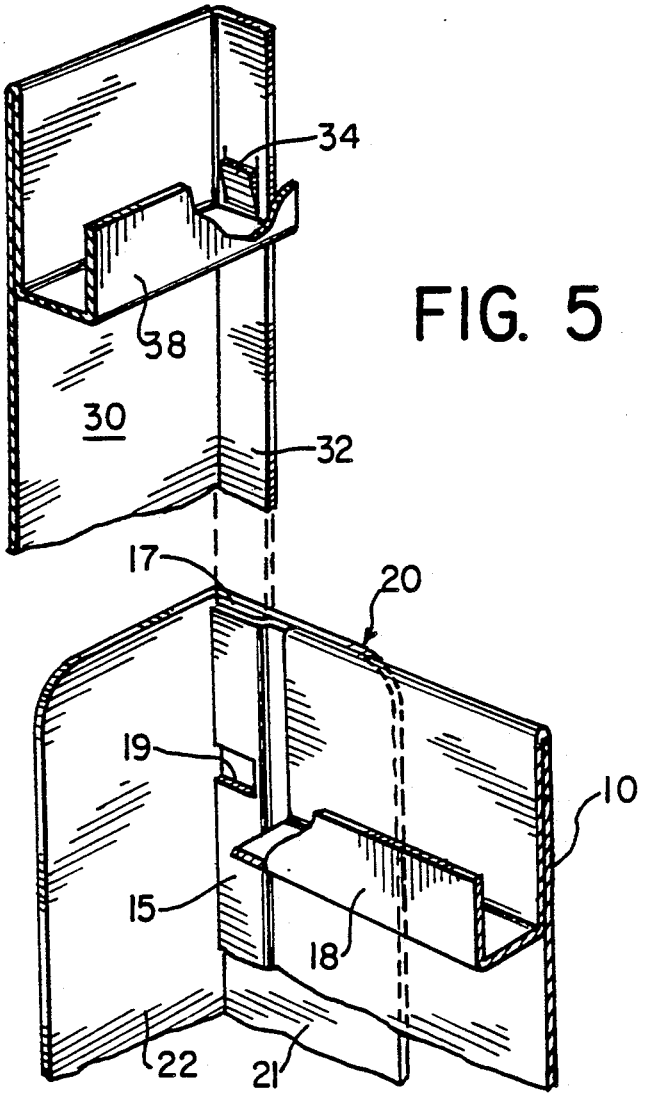
FIG. 5

KNOCKDOWN HANGING FILE

BACKGROUND OF THE INVENTION

This invention relates to furniture that is easily assembled and disassembled, i.e., knockdown furniture, such as typewriter stands, desks, files, cabinets and the like. These types of furniture have parts which can be shipped disassembled or in a collapsed state so as to fit in a relatively flat container. Upon reaching their destination the furniture is put together.

Some knockdown furniture is in the form of parts which are hinged to each other. This type of furniture is easy to assemble and the designs shown in U.S. Pat. No. 1,445,566 of Stoll and U.S. Pat. No. 4,280,744 of Nalcano are representative of this hinged furniture. The problem with hinged furniture is that it does not form a small package.

Another type of knockdown furniture is in the form of separate parts which must be connected to each other after shipment. U.S. Pat. No. 2,615,771 of Curtis, U.S. Pat. No. 3,838,902 of Tenani, U.S. Pat. No. 4,145,098 of Alexander and British Pat. No. 1,477,631 of Harvey et al. are representative. The problem with this type of furniture is that it requires fasteners and tools for assembly.

In the past, efforts have been made to provide furniture which can be purchased by the consumer in its disassembled state and then assembled without tools or fasteners. One example of this is disclosed in U.S. Pat. No. 4,317,416 of Baum et al. in which screw heads on one furniture part are received in raised slotted openings in mating furniture parts.

Although the concept of knockdown furniture is old in the art, more often than not, it is difficult to assemble with or without tools and fasteners. This is because the parts are either too complex and intricate to assemble easily, or because deciphering the instructions may require an inordinate amount of time. Furthermore, fabricated furniture assembled without tools or fasteners is often unsatisfactory because it generally lacks the strength and rigidity required for every day use.

It would be advantageous to have knockdown furniture which is sufficiently stable for everyday use, can be assembled without tools and fasteners, and can be disassembled and shipped in a flat package.

SUMMARY OF THE INVENTION

The present invention is directed to knockdown furniture which can be easily assembled without the use of fasteners or tools. No special skill or dexterity is required for assembly of the parts which comprise the finished product. Furthermore, the individual parts interlock in such a fashion that the furniture can withstand the wear and tear of daily normal use, while still remaining sturdy.

In an illustrative embodiment of the invention, the knockdown furniture is in the form of a file cart for hanging folders. The cart has side panels with depending legs at each corner. Each leg is in the form of a generally L-shaped channel which extends from the top of the side panel the entire width thereof and beyond. The channels at each end of the side panel have first side edges parallel to the side panel and second side edges projecting away from the side panel toward the interior of the cart.

A thin strip is attached, e.g. by welding, vertically along each end of the side panel on the interior side of the cart. As an alternative this strip may be a thinned and crimped portion of the side panel. A flange extends along the bottom of the side panel between the legs and the legs each flange projecting inwardly of the cart and parallel to the side panel. The leg flange extends from the side panel flange to the bottom of the leg.

End panels are adapted to be fitted to the side panels. These end panels have inwardly projecting flanges at both sides and the bottom. During assembly, the end panels are lowered over the side panels so the flanges of the end panel slide behind the strips of the side panels forming an interlock. The end panels are lowered until the bottom flange of the end panel rests on the bottom flange of the side panel and the leg flanges.

This arrangement provides for ease of assembly, and a sturdy construction. However, the rigidity of the structure can be improved by providing a bottom panel that fits inside the side and end panels, and has downwardly projecting flanges that rest on the flanges of the side and end panels.

Brackets may be located along the upper edges of the side and end panels. If those panels are properly dimensioned, the brackets will support letter size hanging folders that extend between the side panels and legal size hanging folders that extend between the end panels. Further, casters may be positioned at the bottom ends of the legs to give the cart increased mobility.

BRIEF DESCRIPTION OF THE DRAWINGS

The foregoing and other features of the present invention will be more readily apparent from the following detailed description and drawings of an illustrative embodiment of the invention in which:

FIG. 3 is an enlarged view of a portion of the file cart along line 3—3 of FIG. 1;

FIG. 5 is an exploded perspective view of a corner of the cart showing the assembly of the end panel of the cart to its side panel.

DESCRIPTION OF THE ILLUSTRATIVE EMBODIMENTS

Figure 1:
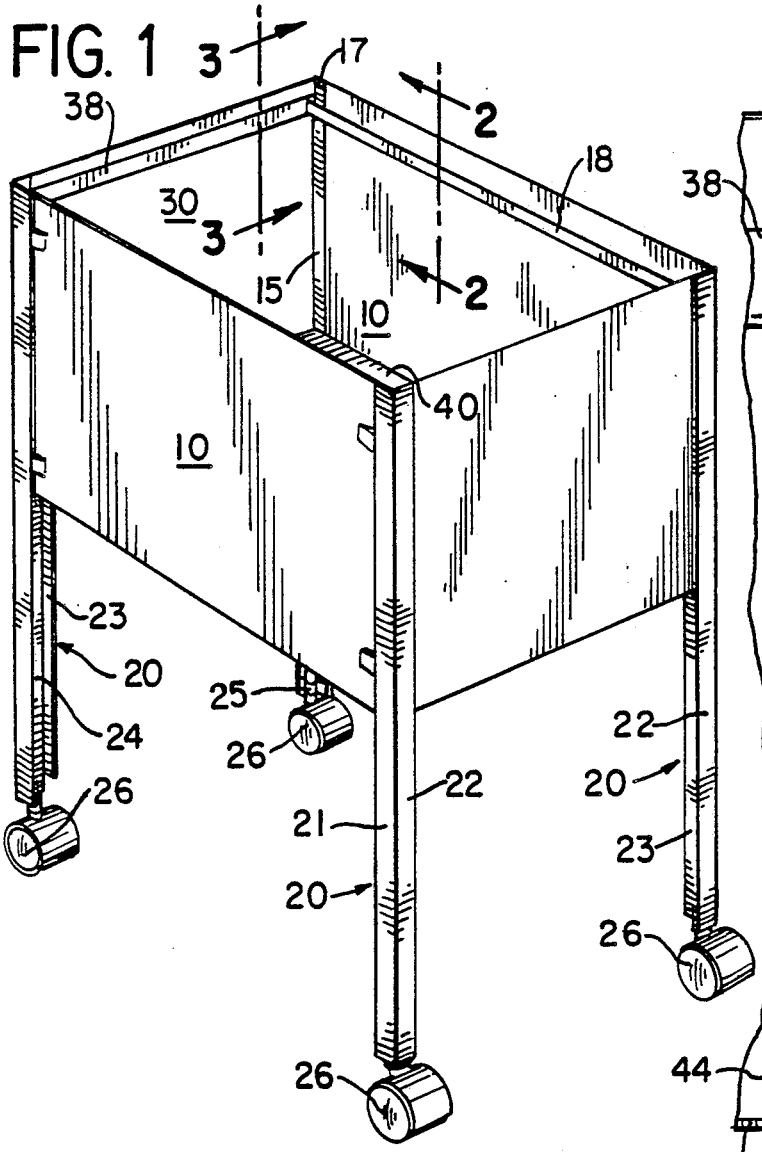
FIG. 1 is a front perspective view of a knockdown hanging file cart in accordance with the present invention.
Figure 6:
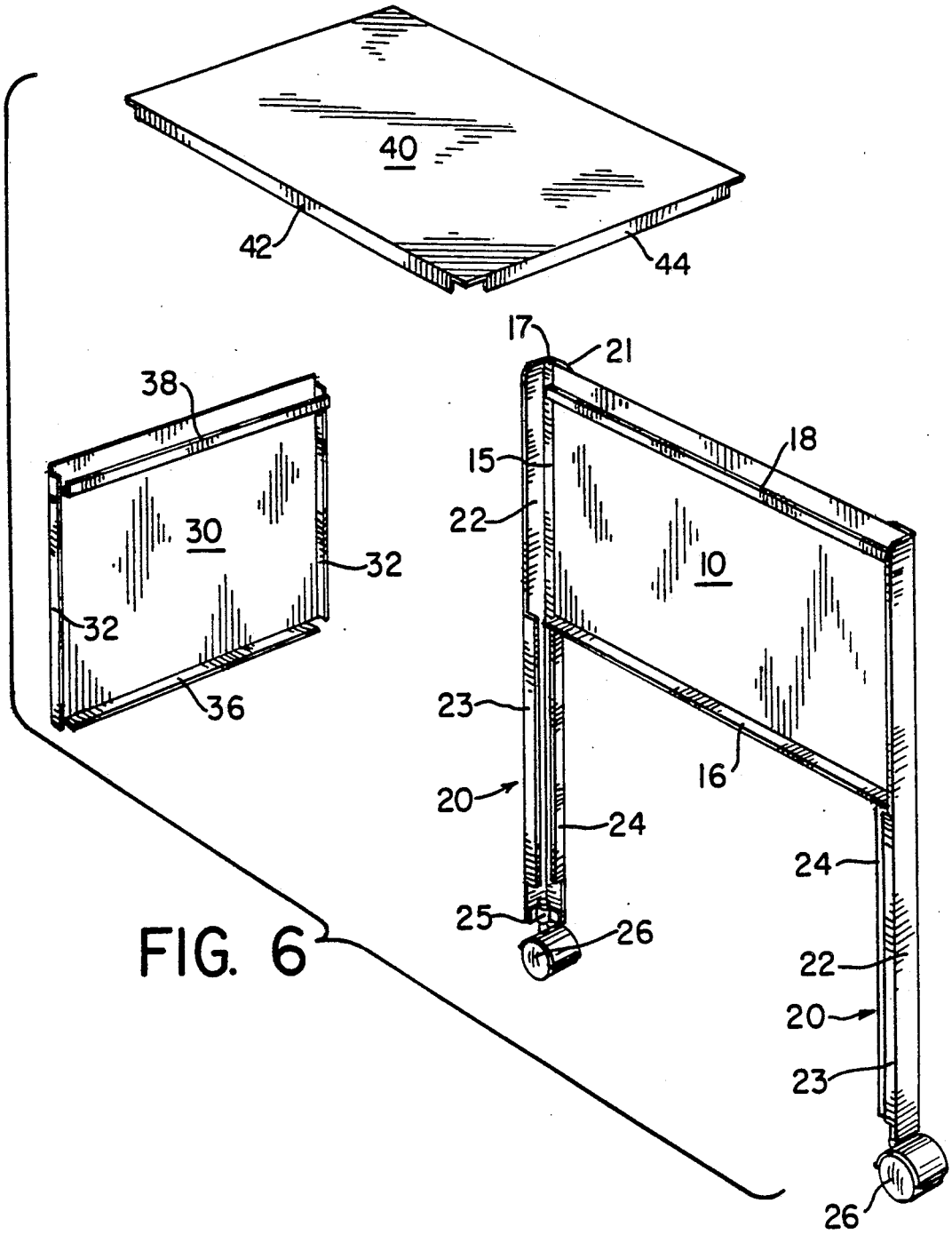
FIG. 6 is an exploded perspective view showing the relationship of the parts immediately prior to assembly.

With reference to the drawings, and particularly FIGS. 1 and 6, it will be observed that a metal hanging file cart according to the instant invention is comprised of a pair of side panels 10. Each side panel is attached to two L-shaped channel leg elements 20 that have perpendicular parts 21, 22. The leg elements 20 are attached to the side panel so that part 21 is parallel with the panel 10 and the part 22 projects perpendicularly from it. The parts 21 of the leg elements 20 are typically welded to the side panel.

Each leg element is also preferably formed with an additional part 23 (FIG. 6) projecting perpendicular to part 22 at an edge opposite the connection of part 21 to part 22. This part 23 extends along the leg 20 from just below the side panel 10 to near its end. An additional part 24 also projects from part 21 at the edge opposite from its connection to part 22. Part 24 extends generally over the same distance on the leg as does part 23. The partially closed channel arrangement of the lower part of each leg formed by parts 21–24, greatly increases the rigidity and sturdiness of the legs.

As shown in FIGS. 1 and 6, there are brackets at the lower ends of each leg 20. These brackets 25 support tubes in which casters 26 are located. While these casters are not necessary, they are preferred because they make the cart easily mobile.

Figure 4:
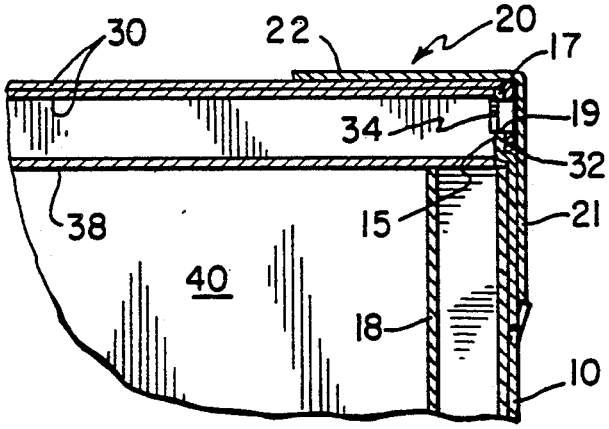
FIG. 4 is an enlarged top view of a portion of the file cart along line 4—4 of FIG. 3.

A thin strip of metal 15 is formed by thinning and crimping the side panel. Alternatively, the strip may be a separate piece attached, e.g. by welding, to the interior of side panel 10 (FIG. 5). This creates a trough 17 into which end panels 30 may fit. As best seen in FIG. 6, end panels 30 have two vertical edge flanges 32 that are perpendicular to the panel. During assembly the end panels fit inside the upper portion of leg part 22 and the flanges 32 are received in the troughs 17. This interconnection is most clear in FIG. 5. FIG. 5 also shows that there is a cut-out or slot 19 in strip 15, and a punched-out tab 34 on flange 32. Because flange 32 is made of metal, as it is slid downwardly during the assembly of the end plate 30 to the side plate 10, tab 34 is depressed. However, when tab 34 reaches cut-out slot 19, it springs outwardly to lock the pieces together (FIGS. 3 and 4). At the same time, flange 36 of panel 30 comes to rest on the top edge of the leg part 23 and the flange 16 of side panel 10. This provides a rigid interlocking of parts that makes the resulting cart stable. Further, this assembly is achieved without the use of tools or fasteners.

If disassembly of the rear plate from the side plate is required, tab 34 must be depressed into slot 19 as the end plate is raised in trough 17.

Figure 2:
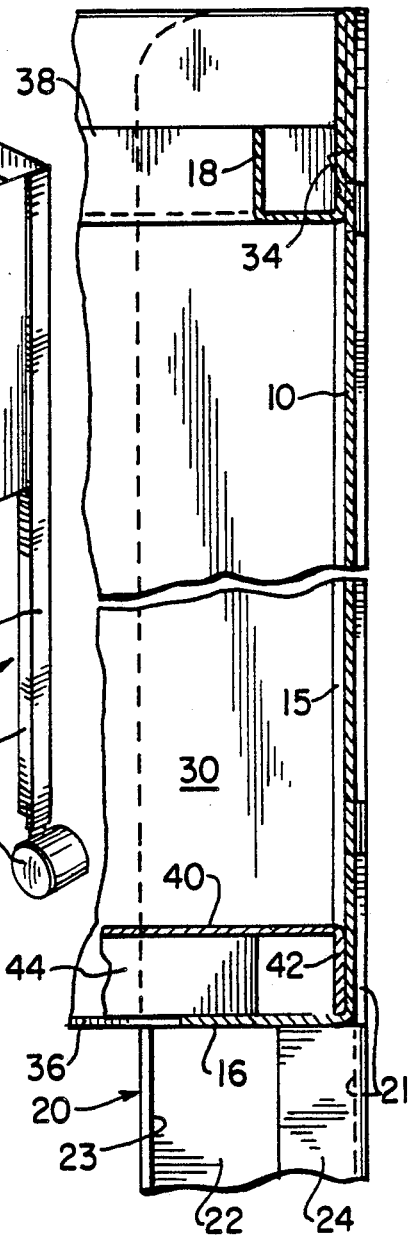
FIG. 2 is an enlarged sectional view of a portion of the file cart along line 2—2 of FIG. 1.

Bottom flange 16 on side panel 10, and flange 36 on end panel 30, project inwardly of the cart at the level of the top of leg parts 23 (FIGS. 2 and 6). Together these flanges form a shelf for supporting a bottom panel 40. Bottom panel 40 has downwardly projecting flanges 42, 44 on the edges facing the side panels 10 and the end panels 30, respectively (FIG. 6). These flanges, rest on the flanges 16, 36 when the bottom panel is installed. This bottom panel increases the rigidly of the cart and can be installed without tools of fasteners.

U-shaped projections 18 and 38 extend from the upper interior walls of side panels 10 and end panels 30, respectively. The projection 18 of the end panel extends completely across the end panel and the projection 38 stops short of the ends of the side panel so as to abut against the projection 18 of the end panel. This relationship also contributes to the rigidity of the cart.

The projections 18, 38 are useful for supporting conventional hanging folders. If the side panels 10 and the panels 30 are the proper length, letter size hanging folders can be suspended from projections 18 on each side panel and legal size hanging folders can be suspended from projections 38 on each end panel, but not at the same time.

Assembly of the cart is readily accomplished by first standing the side panels 10 upright and placing them facing each other. Then a first end panel 30 is slid into the troughs 17 of the two side panels at one end. The locking tabs 34 on the end panel 30 will engage with the locking slots 19 of the side panels 10, thereby effecting a tight union. The bottom panel 40 is then installed by placing one end against the first end panel 30. The bottom panel 40 is kept tilted at an angle until the second end panel 30 is in place. Once a tight union is effected between the second end panel 30 and the side panels, 10, the bottom panel 40 is pressed down, with all its flanges engaging all the flanges of panels, 10, 30. Both the side and end panels, acting with the bottom panel, provide substantially increased sturdiness and strength to the file.

If desired, casters 26 can be inserted into the tubes held by brackets 25 of the leg elements 20, so as to give the cart added mobility.

Thus, a hanging file assembly has been provided which is easily put together without recourse to external fastening means or tools. The interlocking tabs and slots of the side and end panels, in combination with the bottom panel and the U-shaped file suspension projection, all combine to strengthen and reinforce the cart.

While the invention has been particularly shown and described with reference to the preferred embodiments thereof, it will be understood by those skilled in the art that various changes in form and detail may be made therein without departing from the spirit and scope of the invention.

What is claimed:

1. A knockdown furniture piece, comprising:

a pair of side panels, each of said side panels having a strip located along each lateral edge thereof and projecting first generally perpendicular to said side panel and then generally parallel to said side panel in a direction away from said lateral edges of said side panel so as to form one part of an outwardly open trough along each of said lateral edges;

a leg member attached at each said lateral edge of each side panel, each said leg member including a portion parallel to said side panel and extending from said lateral edge so as to form the other part of said open trough, and a portion perpendicular to said side panel and extending spaced from and across the opening of said open trough; and a pair of end panels having end flanges at their lateral edges projecting generally perpendicular to said end panels, said end flanges of said end panels being adapted to be slidably received in the open troughs formed by said side panels and leg members so as to connect said side and end panels together.

2. A piece as claimed in claim 1 wherein each strip has at least one slot along its length and each end flange has a resiliently projecting tab arranged along said end flange such that when said side and end panels are assembled together, the tab projects through the slot and releasably locks the panels together.

3. A piece as claimed in claims 1 or 2 wherein said side and end panels each have a support flange extending generally perpendicularly from a lower edge thereof, and further including a bottom panel adapted to fit within the panels of the piece and to be supported on the support flanges of said side and end panels, said bottom panel engaging said side and end panels to provide rigidity to the container.

4. A piece as claimed in claim 1 further including casters at the ends of said leg member so as to make the piece mobile.

5. A piece as claimed in claim 1 wherein said leg member are generally L-shaped and extend substantially the entire lateral edge of said side panels and beyond, portions of said leg members being parallel to and outside said side panels, and portions being parallel to and outside said end panels when said end panels are assembled on said side panels.

6. A piece as claimed in claim 5 wherein said leg member further include leg flanges at the outer edges of each portion of the L-shape, said leg flanges projecting generally perpendicularly of the L-shaped portions so as to form a partially closed rigid structure.

7. A piece as claimed in claim 1 further including U-shaped file suspension brackets projecting inwardly of said piece from said side panels and end panels, the suspension brackets of said side and end panels abutting each other to give rigidity to said piece.

8. An easily assembled knockdown file cart comprising:

a pair of side panels having strips located along lateral edges thereof, said strips projecting first generally perpendicular to said side panels and then generally parallel to said side panels in an outwardly direction away from said lateral edges so as to form one part of outwardly open troughs, at least one strip on each side panel having at least one slot along its length;

a pair of L-shaped legs attached at said lateral edges of each side panel, a portion of each said leg being generally parallel to said side panels and extending from said lateral edges of said side panels so as to form the other part of said open troughs, and a portion of each said leg being perpendicular to said side panels and extending spaced from and across the opening of said open troughs; and a pair of end panels having end flanges at their lateral edges projecting generally perpendicular to said end panels, said end flanges being adapted to be slidably received in the troughs of said side panels so as to connect said side panels and end panels together, at least one of said end flanges on each end panel having a resiliently projecting tab arranged such that when said side and end panels are assembled together, the tab projects through the slot and releasably locks the panels together; and a pair of channel-shaped legs at each lateral edge of each side panel, a portion of each leg being generally parallel to said end panel and a portion being generally parallel to said side panel and forming the other part of the open troughs.

9. A cart as claimed in claim 8 wherein said side and end panels have a support flange extending from a lower edge thereof, and further including a bottom panel adapted to fit within the container and to be supported on the support flanges of said side and end panels, said bottom panel engaging said side and end panels to provide rigidity to the cart.

10. A cart as claimed in claim 9 further including U-shaped file suspension brackets projecting inwardly of said cart from said side panels and end panels, the suspension brackets of said side and end panels abutting each other to give rigidity to said cart.

* * * * *